United States Patent [19]

Burke

[11] Patent Number: 4,967,630

[45] Date of Patent: Nov. 6, 1990

[54] CHAIN SCRAPER TOOTH FOR SCRAPING WOOD PANELS

[76] Inventor: Jack H. Burke, 31960 Camas Swale Rd., Creswell, Oreg. 97426

[21] Appl. No.: 438,783

[22] Filed: Nov. 20, 1989

[51] Int. Cl.[5] ..... B27B 17/00

[52] U.S. Cl. ..... 83/830; 83/831; 83/838

[58] Field of Search ..... 83/830, 831, 832, 838, 83/839, 840, 835

[56] References Cited

U.S. PATENT DOCUMENTS

| | | | |
|---|---|---|---|
| 325,364 | 9/1885 | Shipe | 83/831 |
| 945,599 | 1/1910 | Purser | 83/832 |
| 1,339,091 | 5/1920 | Benefiel | 83/831 |
| 1,349,557 | 8/1920 | Boswell | 83/831 |
| 2,583,243 | 1/1952 | Tweedie | 83/831 |
| 4,414,876 | 11/1983 | Loigerot | 83/831 |
| 4,841,824 | 6/1989 | Hartmann et al. | 83/830 |

*Primary Examiner*—Douglas D. Watts
*Assistant Examiner*—Scott A. Smith
*Attorney, Agent, or Firm*—James D. Givnan, Jr.

[57] ABSTRACT

A tooth main body defines open ended, crosswise recesses in which cutter elements of lesser width are secured. The cutter elements may be laterally offset from one another and a medial plane of the tooth body for the formation of parallel grooves along a wood panel or other article. Those areas of the recesses not occupied by the cutter elements form gullets into which severed material may pass. The tooth is formed from plate stock to assure uniform tooth thickness which contributes to chain life.

3 Claims, 1 Drawing Sheet

CHAIN SCRAPER TOOTH FOR SCRAPING WOOD PANELScl BACKGROUND OF THE INVENTION

The present invention pertains generally to a tooth for use in an endless rough saw chain for scraping or scarifying wood surfaces during a panel manufacturing process to impart a textured appearance to the panel surface.

In the manufacture of T-1-11 wood panels, used as siding in building construction, it is a standard practice to convey the panels past an endless rough saw chain moving across the panel path. The chain includes teeth having carbide inserts or similar type cutters which the chain drags along the panel surface to cut small, closely spaced grooves to score same to enhance panel appearance. Such treatment of the panels serves to conceal small irregularities on the panel exterior.

The tooth bearing chain is subjected to panel imparted lateral loads which tend to cause rapid wear of the side surfaces of chain links. Heretofore teeth for such rough saw chains have included those of a laminated or two ply nature formed from chain link stock, die stamped to shape and then soldered to one another. One of the tooth pieces, during die stamping, is additionally cut to form recesses each of which receives a cutter element which are in alignment with one another and which extend laterally beyond the plane of a tooth side.

A serious problem encountered in producing a laminated tooth is that tooth thickness will vary in each tooth. It is not uncommon to find a tooth width varying in thickness by several thousandths of an inch. Such thickness variance in a tooth is particularly undesirable when proximate the pin receiving holes of the tooth whereat the tooth is in wiping, surfacial contact with adjacent links of the saw chain. The wear of the high points on the tooth sides will result eventually in a saw chain having tooth wobble which results in uneven spacing between panel serrations to diminish panel value. Occasionally such teeth will delaminate resulting in costly down time of a production line until the rough saw chain can be replaced.

SUMMARY OF THE PRESENT INVENTION

The present tooth is of uniform thickness by reason of being formed in a monolithic manner from a piece of plate stock. Recesses extend transversely through the upper portion of the tooth to receive cutter elements secured in place as by soldering. The cutter elements are of less width than the tooth main body to provide a gullet area to the side of each cutter element. Further, the cutter elements avoid risk of dislodgment by reason of having their sides insert or at least coplanar with the sides of the tooth main body.

Important provisions include the provision of a tooth for use in a rough saw chain the tooth being of a monolithic nature having a uniform thickness or width to minimize chain link wear and hence increase rough saw chain life; the provision of a tooth for a rough saw chain with a gullet located to one side of a tooth cutter element; the provision of a tooth for a rough saw chain wherein the sides of the cutter elements are coplanar with or inset from the main body of the tooth to prevent cutter element dislodgment.

DETAILED DESCRIPTION OF THE PREFERRED EMBODIMENTS

Figure 1:
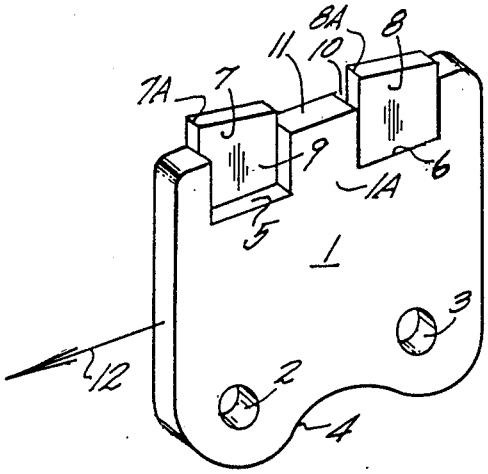
FIG. 1 is a perspective view of the present tooth.
Figure 2:
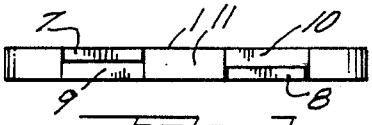
FIG. 2 is a top plan view of FIG. 1.
Figure 3:
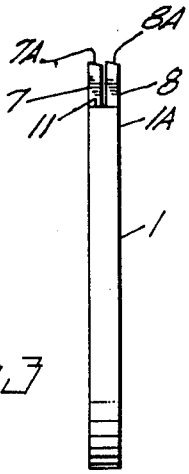
FIG. 3 is an end elevational view taken from the left end of FIG. 1.
Figure 4:
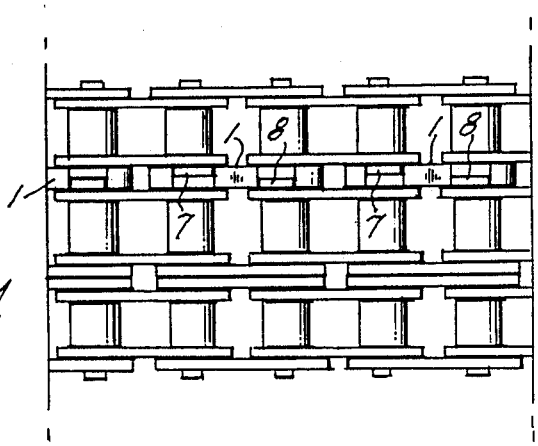
FIG. 4 shows in plan view a segment of rough saw chain.

With continuing attention to the drawings wherein applied reference numerals indicate parts similarly hereinafter identified, the reference numerals applied to the tooth parts are also used to indicate like parts on the drawings wherein reference numeral 1 indicates the main body of the present tooth.

Each tooth has a pair of holes at 2 and 3 to receive pins coupling the tooth to links in an endless rough saw chain. The tooth is rounded along its bottom edge 4 to reduce frictional contact with tooth supporting surfaces.

Main body 1 of the tooth is of a monolithic nature, die stamped from steel plate ranging in thickness of 0.085 to 0.200 thousandths of an inch depending on chain use. Forming of the tooth main body from a single mass importantly assures uniform thickness or width of the tooth.

An upper portion lA of the tooth main body defines transversely extending open ended recesses or cut-outs 5 and 6. A top edge is at 11. Secured in each recess is a cutter element 7 and 8 fixed in place as by silver solder. As the cutter elements may be of lesser thickness than the main body in which instance gullets at 9 and 10 are formed by the unoccupied area of each recess 5 and 6. The cutter elements 7 and 8, if of less width than the main body, are preferably staggered to offset their paths or courses along a panel being treated. The gullets are accordingly alternately located to the side or laterally of each cutter element. The cutter elements may be equal in width to that of the main body.

Assuming the tooth is drawn in the direction of arrow 12, a leading or cutting edge of each cutter is at 7A and 8A.

While I have shown but a few embodiments of the invention, it will be apparent to those skilled in the art that the invention may be embodied still otherwise without departing from the spirit and scope of the invention.

Having thus described the invention, what is desired to be secured by a Letters Patent is:

1. A scraper tooth for use in an endless chain comprised of links with said tooth for scraping building panel surfaces to score same, same tooth comprising, a monolithic tooth main body having parallel sides and a range of thicknesses between 0.085 and 0.200 thousandths of an inch, an upper portion terminating in a top edge of the tooth, said upper portion of the tooth having planar surfaces below said top edge extending across and terminating at the parallel sides of the tooth to define open ended recesses in said upper portion of the tooth, and cutter elements one each partially occupying said recesses and extending beyond said top edge said cutter elements having a width less than the width of said tooth main body.

2. The scrapper tooth claimed in claim 1 wherein said cutter elements are staggered.

3. The scraper tooth claimed in claim 1 wherein said monolithic main body is a metal plate of a thickness approximating twice the thickness of a chain link.

* * * * *